US006883178B2

(12) United States Patent
van der Sleesen

(10) Patent No.: US 6,883,178 B2
(45) Date of Patent: Apr. 26, 2005

(54) GARMENT WITH FULL SILHOUETTE VENTILATION ASSEMBLY

(76) Inventor: Michael van der Sleesen, 23 South Kingman St., Lakeville, MA (US) 02347-1821

( * ) Notice: Subject to any disclaimer, the term of this patent is extended or adjusted under 35 U.S.C. 154(b) by 0 days.

(21) Appl. No.: 10/654,224

(22) Filed: Sep. 3, 2003

(65) Prior Publication Data

US 2005/0066406 A1 Mar. 31, 2005

(51) Int. Cl.[7] ..... A41D 13/00
(52) U.S. Cl. ..... 2/69; 2/108
(58) Field of Search ..... 2/69, 108, 93, 2/85, DIG. 1, 79, 102, 113–115, 105, 106, 104

(56) References Cited

U.S. PATENT DOCUMENTS 3,045,243 A * 7/1962 Seymour et al. ..... 2/1
4,513,451 A * 4/1985 Brown ..... 2/69
4,608,715 A * 9/1986 Miller et al. ..... 2/1
4,996,723 A * 3/1991 Huhn et al. ..... 2/105
5,642,526 A * 7/1997 Thompson ..... 2/79
5,704,064 A * 1/1998 van der Sleesen ..... 2/69
5,752,277 A * 5/1998 van der Sleesen ..... 2/69
6,070,274 A * 6/2000 van der Sleesen ..... 2/456
6,085,353 A * 7/2000 van der Sleesen ..... 2/69
6,339,845 B1 * 1/2002 Burns et al. ..... 2/243.1

* cited by examiner

*Primary Examiner*—Gloria M. Hale
(74) *Attorney, Agent, or Firm*—McDermott Will & Emery LLP

(57) ABSTRACT

A garment with a full silhouette ventilation assembly includes an air permeable front panel, and an air impervious lining sheet that underlies and spans the air permeable panel. The air impervious lining sheet defines an opening, and a cover sheet is provided and shaped to cover the opening. The cover sheet has peripheral edges attached to peripheral portions of the opening by a selectively operable closure assembly, which extends along the peripheral portions of the opening and the peripheral edges of the cover sheet. The air permeable front panel is preferably made of a unitary sheet of a perforated leather, which is substantially non-stretchable, with no cuts or stitches on the panel, so that graphics, such as advertisements, can be painted on or attached to the panel at any locus on the panel as desired, and the panel can still provide ventilation to a wearer.

10 Claims, 4 Drawing Sheets

GARMENT WITH FULL SILHOUETTE VENTILATION ASSEMBLY

FIELD OF THE INVENTION

The present invention relates to ventilated garments, and, in particular, to garment with a full silhouette ventilation assembly.

BACKGROUND OF THE INVENTION

When operating fast moving, relatively open vehicles such as motorcycles, bicycles, and some aircraft, the use of protective apparel is important. However, to be useful, protective apparel must be comfortable enough to wear. Many of the garments commonly used for such applications, such as leather suits and jackets, are unacceptably uncomfortable because they provide poor ventilation. Poor ventilation can be a serious problem during warm or moderate weather.

Wearing poorly ventilated protective apparel is uncomfortable on warm days because poor ventilation causes excessive heat buildup. As a result, the wearer may discard the apparel on warm days. Alternatively, the wearer may partially unfasten the front of the garment to provide some ventilation. However, wearing an unfastened garment can be hazardous when traveling at high speed. Air trapped by the opened garment causes billowing or ballooning of the garment and generates unstable forces on the wearer.

Ventilation assemblies for protective garments are known in the art. One type of prior art garment includes a ventilating assembly having mesh vents at various locations on the garment, particularly at locations requiring little protection, such as the armpits and throat. Air scoops in the garment allow airflow into the mesh vents and through the garment.

The prior art garment with a ventilating assembly generally requires that a relatively large area of the garment be cut to form a ventilation opening. The relatively large ventilation area defined in the garment may degrade aesthetic effect of the garment.

It is therefore an object of the invention to provide a ventilating panel for a garment with an adjustable ventilating assembly that provides increased ventilation over the body of the wearer.

It is also an object of the invention to provide a ventilating panel for a garment that offers increased comfort and simplicity of design.

Other objects and advantages of the present invention will become apparent upon consideration of the appended drawings and description thereof.

SUMMARY OF THE INVENTION

The present invention provides a garment with a full silhouette ventilation assembly. In a preferred embodiment, the silhouette ventilation assembly comprises an air permeable panel, and an air impervious lining sheet that underlies and spans the air permeable panel. The air impermeable lining sheet includes peripheral edges, which is attached to peripheral edges of the air permeable panel, such that there is no stitches on the front panel other than the peripheral edges of the panel. The air impervious lining sheet defines an opening, and a cover sheet shaped to cover the opening. The cover sheet has peripheral edges attached to peripheral portions of the opening by a selectively operable closure assembly, which extends along the peripheral portions of the opening and the peripheral edges of the cover sheet. The cover sheet is preferably air impermeable. The entire air permeable panel preferably uses an air permeable material, such as perforated leather or mesh, so that there is no need to cut a relatively large ventilation opening in the panel. The air permeable panel is preferably a perforated leather, which is substantially non-stretchable. Most preferably, the air permeable panel is a unitary sheet of perforated leather, with no cuts or stitches on the panel, so that graphics, such as advertisements, can be painted on or attached to the panel at any locus on the panel as desired, and the panel can still provide ventilation to a wearer. The garment generally includes only outer panels and inner lining sheets, so that less material is used in the garment, and the weight of the garment is relatively small and the price is relatively cheap.

In one preferred form, the selectively operable closure assembly is a zipper, which preferably includes multiple zip heads. In an alternative form, the closure assembly is a hook and loop fastener. The cover sheet may be fully or partially detachable from the air impermeable lining sheet when the closure assembly is fully or partially opened. The closure assembly is preferably water proofed.

The panel with the improved air venting assembly can be used with any type of garment, including, for example, pants, vests, leggings, chaps, gloves, and full-body suits.

BRIEF DESCRIPTION OF THE DRAWINGS

For a fuller understanding of the nature and the objects of the invention, reference should be made to the following detailed description and the accompanying drawings in which like reference numerals refer to like elements, and in which.

DETAILED DESCRIPTION OF THE PREFERRED EMBODIMENT

Figure 1:
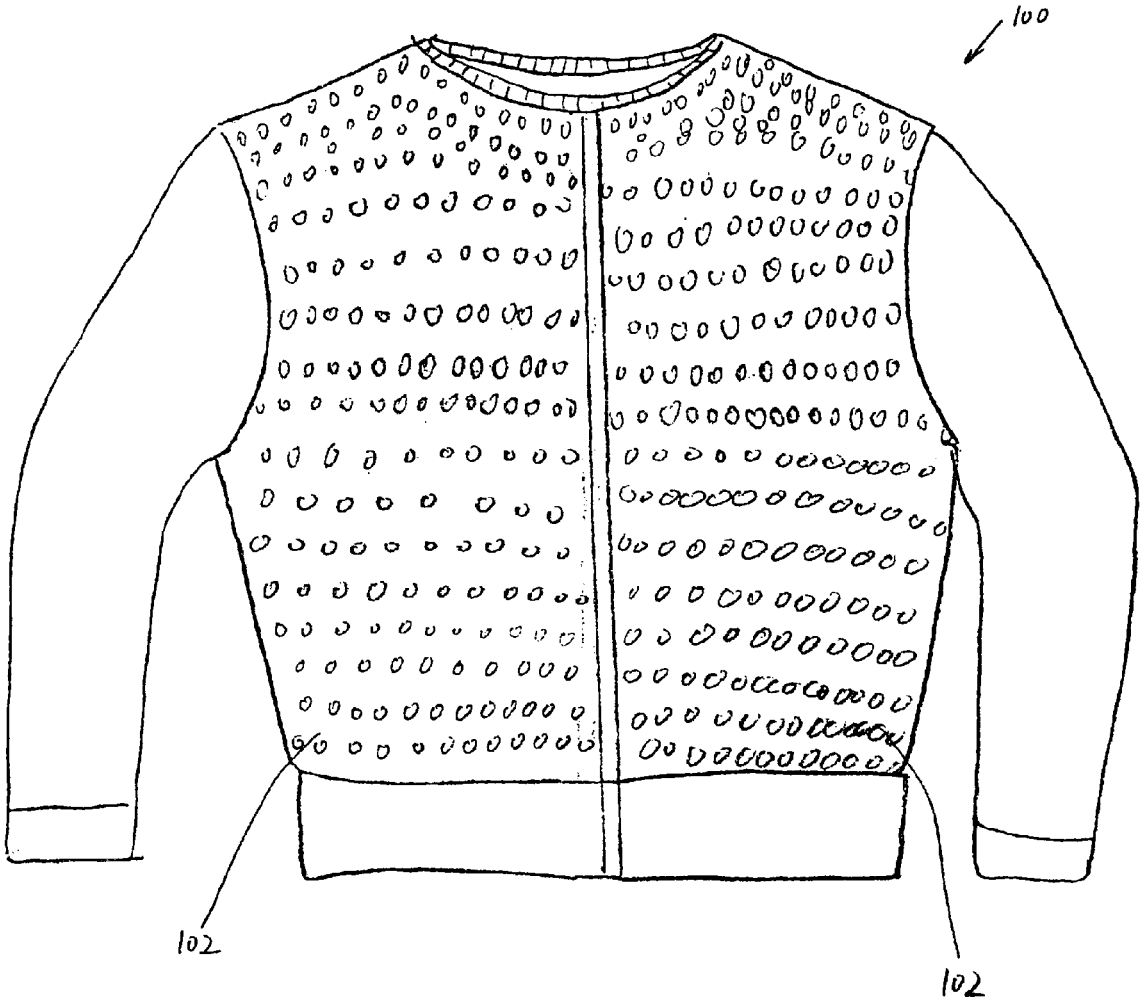
FIG. 1 shows a front schematic view of a full silhouette ventilation assembly in accordance with one preferred embodiment of the present invention, wherein the full silhouette ventilation assembly is used as a front panel of a jacket.

FIG. 1 illustrates a jacket 100 having two air permeable front panels 102 in accordance with one preferred embodiment of the present invention. Each of the air permeable front panels 102 are preferable made of a unitary sheet of perforated leather, which is substantially non-stretchable, and no cuts or stitches on the panel, so that graphics, such as advertisement, can be painted on or attached to the panel at any locus on the panel as desired, and the panel can still provide ventilation to a wearer.

Figure 2:
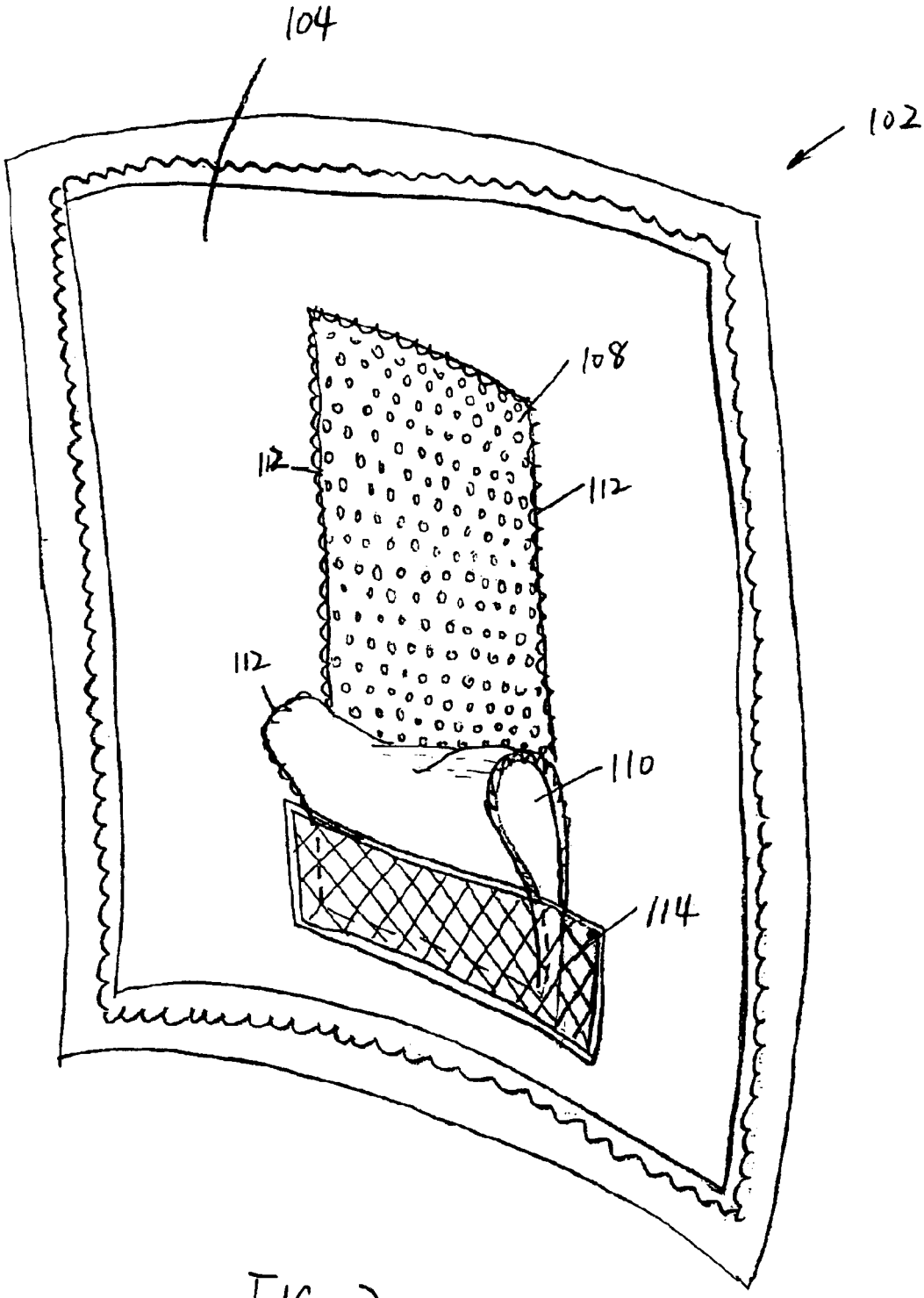
FIG. 2 shows a rear perspective view of a full silhouette ventilation assembly in accordance with one preferred embodiment of the present invention.

FIG. 2 illustrates a perspective rear view of the air permeable front panel 102. An air impermeable lining sheet 104 underlies and spans the inner surface of the air permeable panel 102. The air impermeable lining sheet 104 includes peripheral edges, which are attached to peripheral edges of the air permeable panel 102.

The air impermeable lining sheet 104 defines a vent opening 108, preferably in an upper portion or in a central area of the air impermeable lining sheet 104. An air impermeable cover sheet 110, which is shaped to fully cover the vent opening 108, is attached to peripheral portions of the vent opening 108 by a selectively operable closure assembly 112. The air impermeable cover sheet 110 may be made of the same material as the air impermeable lining sheet 104. The closure assembly 112 extends along the peripheral edges of the air impermeable cover sheet 110 and the peripheral portions of the opening 108. The closure assembly 112 is preferably a zipper or a hook and loop fastener. As shown in FIG. 2, when the closure assembly 112 is opened, the cover sheet 110 can be rolled up, and a portion of the air permeable panel 102 is exposed through the vent opening 108, thereby allowing air to pass through the front panel 102. A wearer can adjust the closure assembly 112 and selectively roll up the cover sheet 110 to control the amount of ventilation.

Figure 2A:
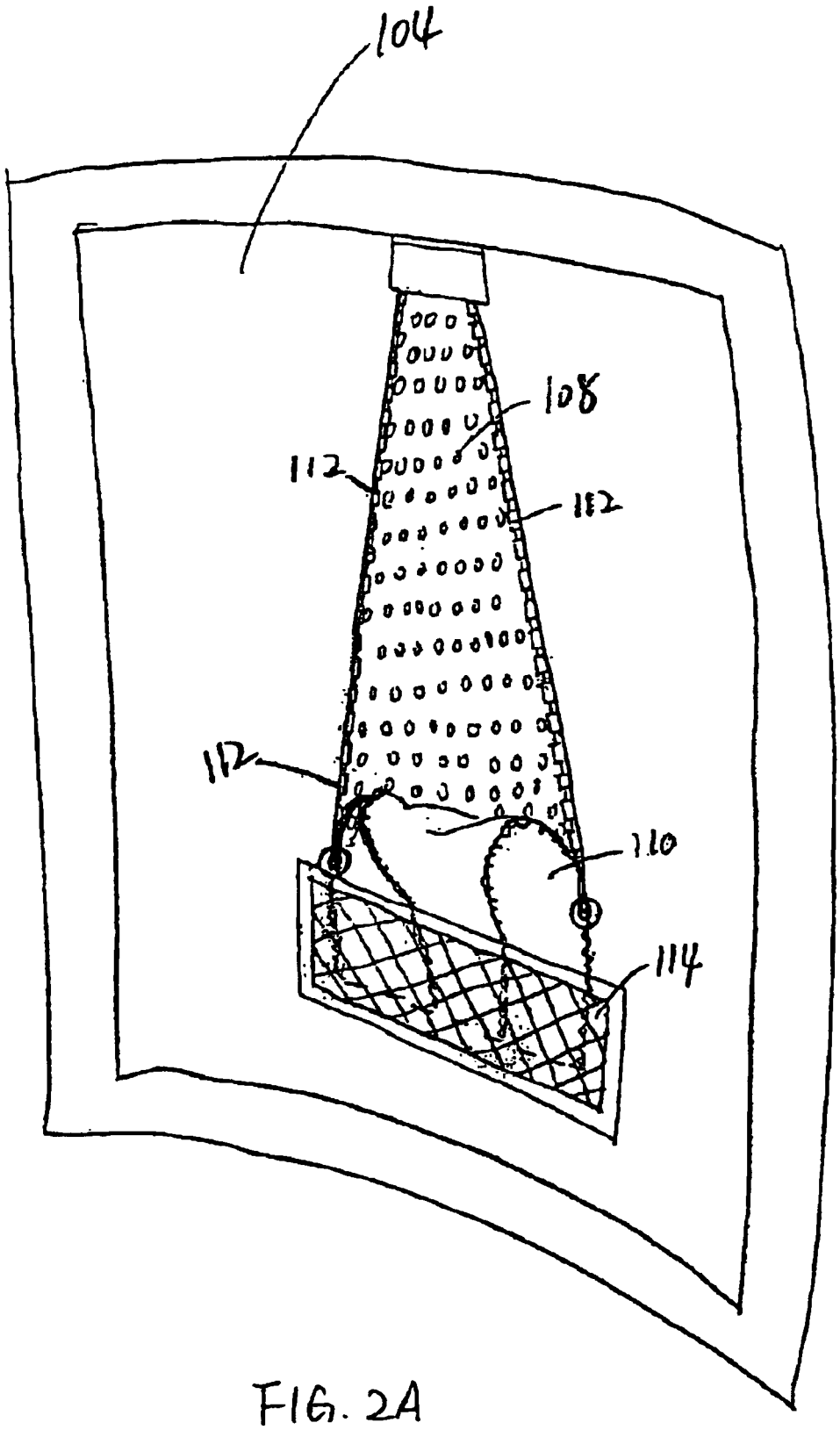
FIG. 2A shows a rear perspective view of a full silhouette ventilation assembly in accordance with another preferred embodiment of the present invention.

In one preferred embodiment, as shown in FIG. 2A, the vent opening 108 and the cover sheet 110 are trapezoidal-shaped. A bottom edge of the air impermeable cover sheet 110 is affixed to a bottom portion of the vent opening 108, and two side edges of the air impermeable cover sheet 110 are attached to two side portions of the opening 108 by the selectively operable closure assembly 112, wherein the selectively operable closure assembly 112 includes two zippers respectively extend along the two side edges of the air impermeable cover sheet 110 and the two side portions of the opening 108.

In one preferred embodiment, as shown in FIGS. 2 and 2A, a sheet, preferably a mesh sheet 114 is affixed to the air impermeable lining sheet 104 near the bottom edge of the vent opening 108, forming a pocket with the air impermeable lining sheet 104, with an opening defined by an upper edge of the mesh sheet 114 and the air impermeable lining sheet 104. The cover sheet 110 can be rolled up and put into the pocket formed by the mesh sheet 114 and the lining sheet 104.

Figure 3:
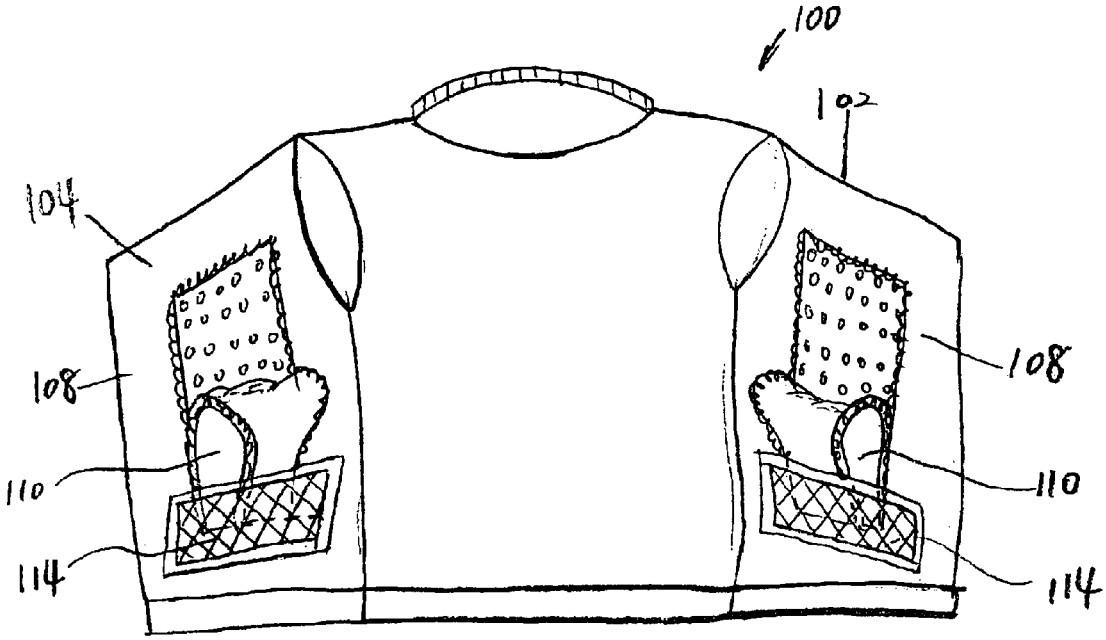
FIG. 3 shows an opened up jacket designed in accordance with one preferred embodiment of the present invention.

In FIG. 3, the jacket 100 is opened up to view the inside of the jacket. As seen in the figure, the jacket 100 employs two front panels as illustrated in FIGS. 2 and 2A. The air permeable front panels 102 preferably use perforated material or mesh, most preferred, perforated leather, so that there is no need to cut a relatively large ventilation opening in the front panel. The jacket generally includes only outer panels and inner lining sheets, so that the weight of the jacket is relatively small and the price is relatively cheap, because less material is used in the jacket. In an alternative embodiment, a mesh sheet is disposed between the front panel and the inner lining sheet of the front panel.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A garment panel comprising:

A. an air permeable panel having peripheral edges;

B. an air impervious lining sheet underlying and spanning said air permeable panel and having peripheral edges attached to the peripheral edges of said air permeable panel, and wherein said air impervious lining sheet defines an opening, and wherein said garment panel further includes an air impermeable cover sheet shaped to cover said opening, said cover sheet having peripheral edges attached to peripheral portions of said opening by selectively operable closure assembly, which extends along the peripheral portions of the opening and the peripheral edges of the cover sheet.

2. A garment panel according to claim 1, wherein said selectively operable closure assembly is a hook and loop fastener.

3. A garment panel according to claim 1, wherein said selectively operable closure assembly is a zipper.

4. A garment panel according to claim 3, wherein said zipper comprises multiple zip heads.

5. A garment panel according to claim 1, wherein said selectively operable closure assembly is water proofed.

6. A garment panel according to claim 1 further comprising a sheet having two opposing edges and a bottom edges affixed to the air impervious lining sheet near a bottom edge of said opening, wherein said sheet and said air impervious lining sheet form a pocket with an opening defined by an upper edge of said sheet and the air impervious lining sheet.

7. A garment panel according to claim 1, wherein said air permeable panel is substantially non-stretchable.

8. A garment panel according to claim 1, wherein said air permeable panel is a unitary sheet.

9. A garment panel according to claim 1, wherein said air permeable panel is a sheet of perforated leather.

10. A garment comprising a front panel made according to claim 1.

* * * * *